US006428294B1

(12) United States Patent
Fenocchi

(10) Patent No.: US 6,428,294 B1
(45) Date of Patent: Aug. 6, 2002

(54) SCROLL COMPRESSOR WITH SLIDER BLOCK HAVING CIRCULAR INNER BORE

(75) Inventor: David M. Fenocchi, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/783,280

(22) Filed: Feb. 13, 2001

(51) Int. Cl.[7] ..... F04C 18/04
(52) U.S. Cl. ..... 418/55.5; 418/55.6; 418/57
(58) Field of Search ..... 418/55.5, 55.6, 418/57

(56) References Cited

U.S. PATENT DOCUMENTS

| | | | | |
|---|---|---|---|---|
| 4,609,334 A | | 9/1986 | Muir et al. | 418/57 |
| 5,295,813 A | | 3/1994 | Caillat et al. | 418/55.5 |
| 5,496,158 A | * | 3/1996 | Barito et al. | 418/55.5 |
| 5,520,524 A | * | 5/1996 | Takemoto et al. | 418/55.5 |
| 5,582,513 A | * | 12/1996 | Shigeoka et al. | 418/55.5 |

FOREIGN PATENT DOCUMENTS

| | | | | |
|---|---|---|---|---|
| DE | 2509536 | | 9/1976 | |
| JP | 4-191489 | * | 7/1992 | 418/55.6 |

* cited by examiner

*Primary Examiner*—John J. Vrablik
(74) *Attorney, Agent, or Firm*—Carlson, Gaskey & Olds

(57) ABSTRACT

An improved slider block for a scroll compressor has a bore including two spaced circular portions centered on a common axis. A recess is formed into one of the curved portions to provide additional clearance for movement of an eccentric pin. The recess allows the eccentric pin to move within the bore, as the relative position of the slider block and the eccentric pin move and change during operation of the scroll compressor.

5 Claims, 2 Drawing Sheets

SCROLL COMPRESSOR WITH SLIDER BLOCK HAVING CIRCULAR INNER BORE

BACKGROUND OF THE INVENTION

This invention relates to a slider block for a scroll compressor wherein the inner bore of the slider block has a clearance recess to allow for movement of the eccentric pin that moves relative to the slider block bore.

Scroll compressors are becoming widely utilized in refrigerant compression applications. In a scroll compressor a first scroll member has a generally spiral wrap extending from a base. A second scroll member has its own wrap which interfits with the spiral wrap of the first scroll member. The second scroll member is caused to orbit relative to the first scroll member to entrap and then compress a refrigerant. The second scroll member is generally driven to orbit by an electric rotary motor driving the second scroll member through a Oldham coupling. The connection between the driveshaft of the motor and the orbiting scroll is through a slider block, such that the second scroll has the ability to move relative to the first scroll under certain circumstances. Typically, the shaft has an eccentric pin extending upwardly into an opening in the slider block. The opening has a flat drive surface that is in contact with a barrel shaped drive surface on the eccentric pin. The bore of the slider block has two opposed curved surfaces. The pin may slide relative to the flat surface on the slider block, such that the orbiting scroll can move towards and away from the wrap on the first scroll member.

In one type of slider block, the accurate surfaces that define the two curved portions of the bore need to be spaced relatively far inwardly to provide for additional structure on the outer periphery of the slider block. In particular, one type of slider block has an oil notch at its side. The formation of the oil notch requires that the curved surface be spaced relatively far inwardly to provide for sufficient wall thickness. However, if the wall is sufficiently thick such that the curved surface is spaced inwardly, it may well be there is insufficient clearance for the pin to move to certain positions with out contacting the opposed curved surface.

The present invention is directed to addressing the above-mentioned problem.

SUMMARY OF THE INVENTION

A scroll compressor is provided with a slider block having a pair of curved opposed surfaces. The surfaces are preferably centered on a common center line. A pair of drive flats separates the two curved surfaces. A recess is formed into one of the two curved surfaces to provide additional clearance for movement of the eccentric pin. Preferably the recess is generally opposed to structure on the outer periphery of the slider block; the structure is preferably a notch to allow for flow of oil. The notch is associated with one of the two curved surfaces, and the curved surface is spaced inwardly from the notch to provide sufficient wall thickness. The inwardly spaced curved surface results in the need for additional clearance provided by the recess.

These and other features of the present invention can be best understood from the following specification and drawings, the following of which is a brief description.

DETAILED DESCRIPTION OF A PREFERRED EMBODIMENT

Figure 1:
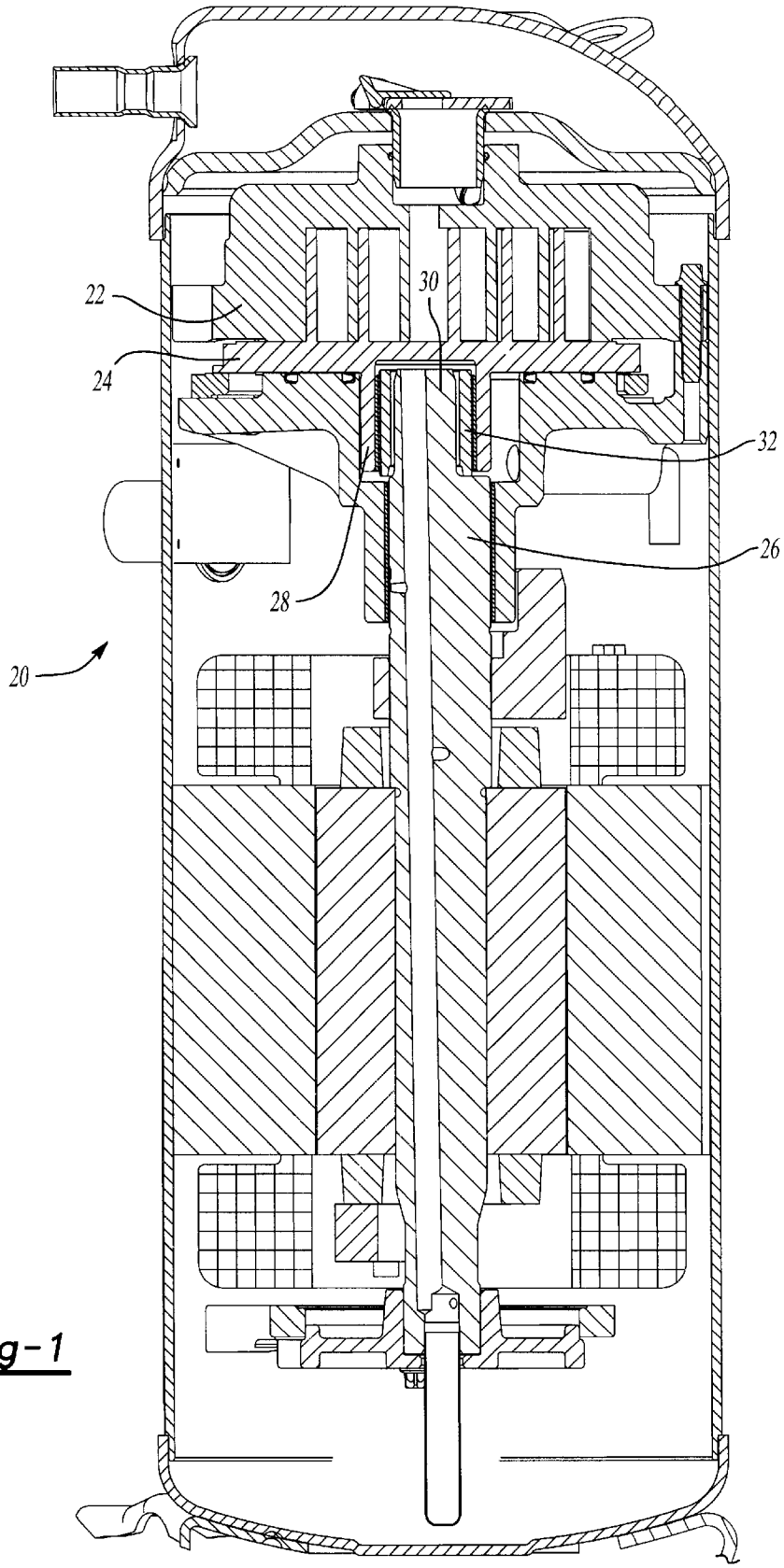
FIG. 1 is a cross-sectional view through a scroll compressor.

FIG. 1 illustrates a scroll compressor 20 having a non-orbiting scroll 22 and an orbiting scroll 24. As known, a driveshaft 26 is driven to rotate, and has an eccentric pin 30 extending upwardly into a bore 28 in the orbiting scroll 24. A slider block 32 is positioned between the pin 30 and the bore 28.

Figure 2:
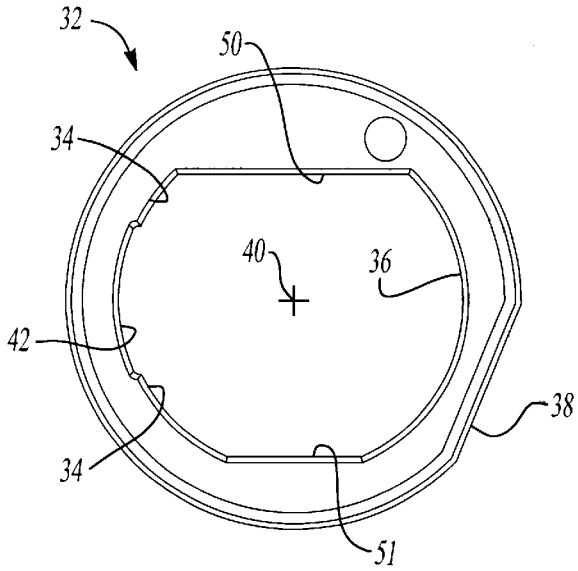
FIG. 2 is a cross-sectional view through the inventive slider block.

As shown in FIG. 2, the slider block 32 has an inner peripheral bore defining a first curved surface 34 with two circumferentially spaced portions, and an opposed second curved surface 36. Intermediate the two curved portions 34 is a curved recess 42. Curved surfaces 34, 36 and 42 are all centered on a common point 40. Thus, surfaces 34 and 36 are essentially portions of the same circle, whereas portion 42 is a circle with the same center, but a slightly larger radius. As shown, a notch 38 is formed on the outer periphery of the slider block 32. The notch 38 allows for oil flow between the slider block and the bearing generally positioned outwardly of the slider block which is visible in FIG. 1.

Figure 3:
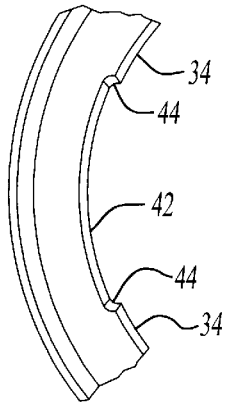
FIG. 3 shows a portion of the FIG. 2 slider block.

FIG. 3 is an enlarged view of the recess 42. As can be seen, end ledges 44 of the recess 42 merge into the curved portions 34.

Figure 4:
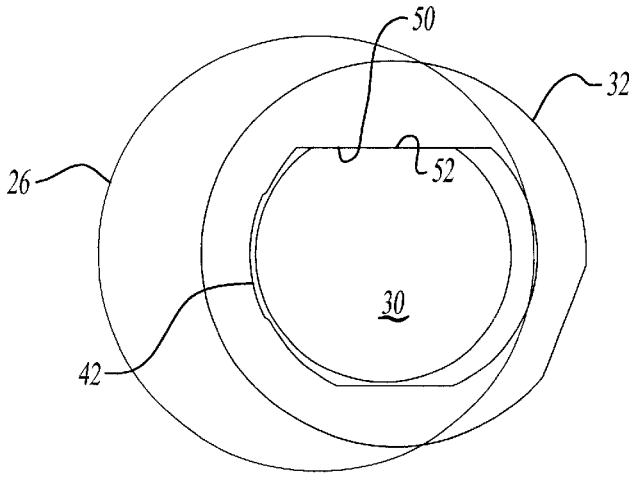
FIG. 4 is a cross-sectional view showing the inventive slider block and the eccentric drive pin.

FIG. 4 shows the eccentric pin 30 received within the bore. The eccentric pin is shown in the position where it is spaced as far to the left in this figure as it will typically be. As can be seen, a portion of the outer periphery of the eccentric pin 30 would now extend into the recess 42. If the recess 42 were not there, there could be contact, which would be undesirable. Further, as is shown in FIG. 4, the flat 50 within the bore of the slider block is in driving engagement with a barrel surface 52 from the drive pin 30.

A preferred embodiment of this invention has been disclosed. However, a worker in this art would recognize that certain modifications would come within the scope of this invention. For that reason the following claims should be studied to determine the true scope and content of this invention.

I claim:

1. A scroll compressor comprising:

a first scroll member having a generally spiral wrap extending from a base and a second scroll member having a generally spiral wrap extending from its base;

a driveshaft for driving said second scroll member to orbit relative to said first scroll member, said second scroll member having a downwardly extending boss, said driveshaft having an eccentric pin extending upwardly into said boss; and a slider block received between said eccentric pin and said boss of said second scroll member, said slider block having an inner bore receiving said eccentric pin, with said slider block and said eccentric pin having surfaces in engagement for transmitting movement, said bore of said slider block including a pair of circumferentially spaced first and second curved portions, and a recess extending into said first curved portion such that said recess is spaced further from a center of curvature of said first curved portion then said first of said curved portions wherein said first and second curved portions are circular arcs entered on the same axis.

2. A scroll compressor as recited in claim 1, wherein said recess is also a circular portion centered on said axis of said first and second curved portions.

3. A scroll compressor as recited in claim 1, wherein an oil notch is formed at an outer periphery of said slider block at a position associated with the other of said curved portions.

4. A scroll compressor comprising:

a first scroll member having a generally spiral wrap extending from a base and a second scroll member having a generally spiral wrap extending from its base;

a driveshaft for driving said second scroll member to orbit relative to said first scroll member, said second scroll member having a downwardly extending boss, said driveshaft having an eccentric pin extending upwardly into said boss;

a slider block received between said eccentric pin and said box, said slider block having an inner bore receiving said eccentric pin, with said slider block and said eccentric pin having surfaces in engagement for transmitting movement, said eccentric pin moving relative to said slider block such that said surfaces come into engagement along a first direction, said bore of said slider block including a pair of circumferentially spaced first and second curved portions, with said curved portions being spaced upon opposed sides of said direction of relative movement of said slider block and said eccentric pin, and such that said curved portions are spaced on opposed sides of said engagement surfaces and a recess extending into one of said curved portions such that said recess is spaced further from a center of curvature of said one of said curved portions then said one of said curved portions, said first and second curved portions being circular arcs centered on an common axis with said recess also being a circular portion centered on said axis of said first and second curved portions; and an oil notch formed at an outer periphery of said slider block at a position associated with the other of said curved portions.

5. A scroll compressor comprising:

a first scroll member having a generally spiral wrap extending from a base and a second scroll member having a generally spiral wrap extending from its base;

a driveshaft for driving said second scroll member to orbit relative to said first scroll member, said second scroll member having a downwardly extending boss, said driveshaft having an eccentric pin extending upwardly into said boss; and a slider block received between said eccentric pin and said boss of said second scroll member, said slider block having an inner bore receiving said eccentric pin, with said slider block and said eccentric pin having surfaces in engagement for transmitting movement, said eccentric pin moving relative to said slider block such that said surfaces come into engagement along a first direction, said bore of said slider block including a pair of circumferentially spaced first and second curved portions, with said curved portions being spaced upon opposed sides of said direction of relative movement of said slider block and said eccentric pin, and such that said curved portions are spaced on opposed sides of said engagement surfaces said curved portions being circular arcs centered on a common axis, with a pair of generally flat portions which are positioned circumferentially intermediate spaced circumferential ends of said first and second curved portions.

* * * * *

UNITED STATES PATENT AND TRADEMARK OFFICE

CERTIFICATE OF CORRECTION

PATENT NO. : 6,428,294 B1
DATED : August 6, 2002
INVENTOR(S) : Fenocchi

It is certified that error appears in the above-identified patent and that said Letters Patent is hereby corrected as shown below:

Column 2,
Line 64, "entered" should be -- centered --

Signed and Sealed this

Third Day of December, 2002

JAMES E. ROGAN
*Director of the United States Patent and Trademark Office*